United States Patent [19]

Nishimura et al.

[11] 4,166,048

[45] Aug. 28, 1979

[54] HIGH FOAMING DETERGENT COMPOSITION HAVING LOW SKIN IRRITATION PROPERTIES

[75] Inventors: Masaaki Nishimura, Sakura; Haruhiko Arai, Narashino, both of Japan

[73] Assignee: Kao Soap Co., Ltd., Tokyo, Japan

[21] Appl. No.: 900,178

[22] Filed: Apr. 26, 1978

Related U.S. Application Data

[63] Continuation of Ser. No. 725,182, Sep. 21, 1976, abandoned.

[30] Foreign Application Priority Data

Sep. 22, 1975 [JP] Japan ..... 50/114510

[51] Int. Cl.[2] ..... C11D 1/14; C11D 1/84

[52] U.S. Cl. ..... 252/546; 252/547; 252/551; 252/DIG. 14

[58] Field of Search ..... 252/541, 527, 546, 547, 252/548, 551, DIG. 14

[56] References Cited

U.S. PATENT DOCUMENTS

| | | | |
|---|---|---|---|
| 2,766,212 | 10/1956 | Grifo | 252/551 |
| 3,332,876 | 7/1967 | Walker | 252/551 X |
| 3,440,171 | 4/1969 | Warren | 252/548 |
| 3,812,041 | 5/1974 | Inamorato | 252/89 |
| 3,812,042 | 5/1974 | Verdier | 252/90 |
| 3,822,312 | 7/1974 | Sato et al. | 252/527 |
| 4,024,078 | 5/1977 | Gilbert et al. | 252/551 |
| 4,092,272 | 5/1978 | Nishimura et al. | 252/545 |
| 4,132,678 | 1/1979 | Iigima et al. | 252/545 |
| 4,132,679 | 1/1979 | Tsutsumi et al. | 252/545 |
| 4,133,779 | 1/1979 | Hellyer et al. | 252/547 |

FOREIGN PATENT DOCUMENTS

| | | |
|---|---|---|
| 1249433 | 9/1967 | Fed. Rep. of Germany . |
| 2024962 | 12/1971 | Fed. Rep. of Germany . |
| 2457239 | 6/1975 | Fed. Rep. of Germany . |
| 1526645 | 5/1968 | France . |
| 7028905 | 9/1970 | Japan . |
| 7143550 | 12/1971 | Japan . |

*Primary Examiner*—P. E. Willis, Jr.

*Attorney, Agent, or Firm*—Blanchard, Flynn, Thiel, Boutell & Tanis

[57] ABSTRACT

A detergent composition comprising 5 to 40% by weight of a mixture of polyoxyethylene alkyl ether sulfate salts having the formula (I):

$$RO(C_2H_4O)_nSO_3M \quad (I)$$

wherein R is alkyl having an average carbon atom number of 11 to 16, n is 1.0 to 2.6 as the average value of the mixture with the proviso that the content of compounds in which n is zero is from zero to 5% by weight, and M is a monovalent or divalent metal ion with the proviso that compounds having a divalent metal ion as M comprise 15 to 98% by weight of the entire mixture, and a betaine type amphoteric surface active agent having the formula (II):

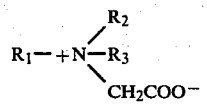

(II)

wherein $R_1$ is alkyl having 8 to 20 carbon atoms and $R_2$ and $R_3$ are alkyls having 1 to 3 carbon atoms, the weight of the betaine type amphoteric surface active agent being from 0.01 to 2 times the weight of the polyoxyethylene alkyl ether sulfate salt mixture.

8 Claims, No Drawings

HIGH FOAMING DETERGENT COMPOSITION HAVING LOW SKIN IRRITATION PROPERTIES

This is a continuation, of application Ser. No. 725,182, filed Sept. 21, 1976, now abandoned.

BACKGROUND OF THE INVENTION

1. Field of the Invention

The present invention relates to a detergent composition which has a very mild action on skin and a very excellent washing power.

2. Description of the Prior Art

Tableware, vegetables, hair, skin and cloths of very fine and delicate fibers, such as silk, wool and acetate fibers, are generally washed by hand. Accordingly, detergents used for washing these objects are required to have a high washing power and a very mild action on skin so as not to cause chapping of the skin on hands. Polyoxyethylene alkyl ether sulfate salts having a relatively mild action on the skin have been used for washing these objects. However, these salts are not fully satisfactory with respect to preventing irritation of skin or skin chapping. Especially, these salts in which the average mole number of added ethylene oxide units is small tend to cause irritation of skin or skin chapping.

Further, conventional liquid detergents comprising a polyoxyethylene alkyl ether sulfate salt are inferior in solution stability and are readily frozen at low temperatures. As the average alkyl chain length is increased, the solution stability becomes poorer in these detergents. Accordingly, these detergents cannot be put into practical use. Further, these detergents have an insufficient washing power with respect to oily contaminants.

SUMMARY OF THE INVENTION

We have discovered that when a polyoxyethylene alkyl ether sulfate salt mixture in which the content of unreacted alkyl sulfate salt (n=zero) is less than 5% by weight, is used in combination with a betaine-type amphoteric surface active agent, there is obtained a liquid detergent having a very mild action on skin and a very excellent washing power to oily contaminants, and this liquid detergent has a very good solution stability in the solution state. We have now completed the present invention based on this finding.

More specifically, in accordance with the present invention, there is provided a detergent composition comprising 5 to 40% by weight of a mixture of polyoxyethylene alkyl ether sulfate salts having the formula (I):

$$RO(C_2H_4O)_nSO_3M \quad (I)$$

wherein R is alkyl having an average carbon atom of from 11 to 16 for the mixture, n is 1.0 to 2.6 as the average value of the mixture with the proviso that the content of compounds in which n is zero for from zero to 5% by weight, and M is a monovalent metal ion, preferably Na or K, especially Na, or divalent metal ion, preferably Ca or Mg or mixtures thereof, especially Ca, with the proviso that compounds having a divalent metal ion as M comprise 15 to 98, especially from 30 to 98, % by weight of the entire mixture, and 0.1 to 20% by weight of a betaine-type amphoteric surface active agent having the formula (II):

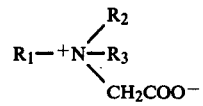

(II)

wherein $R_1$ is alkyl having 8 to 20 carbon atoms, especially lauryl, and $R_2$ and $R_3$ are alkyls having 1 to 3 carbon atoms, especially methyl, the weight of the betaine-type amphoteric surface active agent being from 0.01 to 2 times, especially from 0.03 to 0.5 times the weight of the polyoxyethylene alkyl ether sulfate salt mixture.

In the detergent composition of the present invention, the mild action on skin and the high washing power are attained by the combined use of the above-mentioned specific polyoxyethylene alkyl ether sulfate salt and the betaine-type amphoteric surface active agent. Further, because the betaine-type amphoteric surface active agent is used in combination with the sulfate salt, a good washing power to oily contaminants is attained.

The polyoxyethylene alkyl ether sulfate salt mixture is prepared by adding ethylene oxide to a starting alcohol, esterifying the resulting adduct with sulfuric acid and neutralizing the ester. In this process, ethylene oxide units are not added to a portion of the starting alcohol and that portion of the starting alcohol is directly esterified and neutralized. Thus the resulting salt mixture contains a considerable amount of the thus-formed alkyl sulfate ester. This alkyl sulfate ester is highly irritating to skin and causes skin chapping and irritation. Further, this salt is inferior in its solubility and its aqueous solution has a high melting point. Accordingly, a composition containing this salt is inferior in its solution stability and is readily frozen at low temperatures. However, if a polyoxyethylene alkyl sulfate salt mixture containing such alkyl sulfate salt in an amount of from zero to 5% by weight is employed, a detergent composition having a much reduced skin-irritation property and a very high washing power is obtained.

The starting alcohol of the polyoxyethylene alkyl ether sulfate salt mixture has an alkyl group having 11 to 16 carbon atoms on the average, and the polyoxyethylene alkyl ether sulfate salt mixture used in the present invention, which is represented by the formula $RO—(CH_2CH_2O)_n—SO_3M$, is synthesized from such alcohol. It is necessary that the average mole number of ethylene oxide units added to the starting alcohol is in the range of from 1 to 2.6. When the average carbon atom number of the alkyl group is too large, the washing power and the foaming property are reduced. Further, when the average carbon atom number of the alkyl group is too large, the solution stability is degraded. When the average added ethylene oxide mole number is larger than 2.6, the foaming property and the washing power are reduced. When the amount of the alkyl sulfate salt in which the added ethylene oxide mole number is zero is larger than 5% by weight, the skin irritation property and chapping-causing tendency are increased and the stability of a solution of the resulting detergent is drastically lowered.

In short, the active washing component of the composition of the present invention is a polyoxyethylene alkyl sulfate salt mixture in which the average carbon atom number of the alkyl group is from 11 to 16, the average mole number of added ethylene oxide units is from 1 to 2.6 and the content of the polyoxyethylene alkyl sulfate salt in which the mole number of added ethylene oxide units is zero is from zero to 5% by weight. This active component has an excellent washing power and solution stability and it has a much reduced skin-irritation property. The use of a salt mixture in which (a) the content of the salt, having an added ethylene oxide number n of zero, is from zero to 5% by weight, (b) the content of salts, having an added ethylene oxide mole number n of 1 or 2, is higher than 77% by weight and (c) the content of the salts, having an added ethylene oxide mole number n of 3 or more, is from zero to 18% by weight is especially preferred.

In the ethylene oxide adduct of the starting alcohol, the unreacted alcohol (the added ethylene oxide mole number n being zero) and the higher adducts (for example, the added ethylene oxide mole number n being 3 or more) can easily be removed by distillation. Sulfuric acid esterification and subsequent neutralization of the ethylene oxide adduct of the starting alcohol can easily be performed according to conventional methods.

Known detergent additives can be added to the detergent composition comprising the above-mentioned polyoxyethylene alkyl ether sulfate salt and betaine-type amphoteric surface active agent, according to need. For example, in the case of a liquid detergent, there can be used solubilizing agents such as urea, ethanol, propylene glycol, glycerin, p-toluene-sulfonic acid salts, xylene-sulfonic acid salts and naphthalene-sulfonic acid salts, auxiliary surface active agents such as alkylamine oxides, alkyl pyrrolidones and fatty acid alkanol amides, washing power-improving inorganic and organic builders, enzymes, opacifying agents, colorants, preservatives and perfumes.

The present invention will now be further described in detail by reference to the following illustrative Examples. In the Examples all references to "%" are percent by weight.

EXAMPLE 1

Detergent compositions set forth in the following table were tested with respect to their washing power, foaming property and enzyme inhibition rate. Samples 1 to 3 are detergents according to the present invention and samples 4 to 12 are comparative detergents.

Table

| Average $\bar{R}$ | Average $\bar{n}$ | n=0% | Mixtues of Compounds of Formula (I) Weight Ratio of Ca/Na Compounds | Sample No. (weight percent) 1 | 2 | 3 | 4 | 5 | 6 | 7 | 8 | 9 | 10 | 11 | 12 |
|---|---|---|---|---|---|---|---|---|---|---|---|---|---|---|---|
| 13 | 1.5 | 3 | 70/30 | 20 | | | | | | | | | | 20 | |
| 13 | 1.5 | 35 | 70/30 | | | | 20 | | | | | | | | |
| 13 | 3.5 | 4 | 70/30 | | | | | 20 | | | | | | | |
| 13 | 1.5 | 3 | 10/90 | | | | | | 20 | | | | | | |
| 13 | 1.5 | 3 | 70/30* | | 20 | | | | | | | | | | |
| 14.5 | 2 | 2 | 50/50 | | | 20 | | | | | | | | | 20 |
| 14.5 | 2 | 45 | 50/50 | | | | | | | 20 | | | | | |
| 14.5 | 4 | 2 | 50/50 | | | | | | | | 20 | | | | |
| 14.5 | 2.5 | 30 | 5/95 | | | | | | | | | 20 | | | |
| 18 | 2 | 4 | 60/40 | | | | | | | | | | 20 | | |

| | Sample No. 1 | 2 | 3 | 4 | 5 | 6 | 7 | 8 | 9 | 10 | 11 | 12 |
|---|---|---|---|---|---|---|---|---|---|---|---|---|
| dimethyllauryl betaine | 3 | 3 | 3 | 3 | 3 | 3 | 3 | 3 | 3 | 3 | 0 | 0 |
| ethyl alcohol | 15 | 15 | 15 | 15 | 15 | 15 | 15 | 15 | 15 | 15 | 15 | 15 |
| urea | 5 | 5 | 5 | 5 | 5 | 5 | 5 | 5 | 5 | 5 | 5 | 5 |
| ammonium chloride | 0.1 | 0.1 | 0.1 | 0.1 | 0.1 | 0.1 | 0.1 | 0.1 | 0.1 | 0.1 | 0.1 | 0.1 |
| perfume | 0.3 | 0.3 | 0.3 | 0.3 | 0.3 | 0.3 | 0.3 | 0.3 | 0.3 | 0.3 | 0.3 | 0.3 |
| water | ← balance → | | | | | | | | | | | |
| number of washed dishes | 5 | 5 | 5 | 4 | 2 | 2 | 4 | 1 | 2 | 1 | 1 | 2 |
| foaming property (mm) | 80 | 80 | 80 | 75 | 8 | 20 | 70 | 10 | 25 | 15 | 10 | 8 |
| the degree of inhibition of enzyme activity | 7 | 7 | 6 | 96 | 8 | 6 | 98 | 8 | 93 | 15 | 112 | 10 |

Note:
*Mg/Na

Washing Power Test

A mixture of 5 g of beef tallow with 0.1% of Sudan III (red) as an indicator was applied to a dish (having a diameter of 25 cm), and the dish was washed by rubbing it with a sponge impregnated with 10 g of the detergent and 20 g of water. The washing power was evaluated based on the number of dishes that could be washed to such an extent that the beef tallow was completely removed.

Foaming Property Test

Commercially available butter was used as a contaminant and 0.1% of the contaminant was added to a detergent solution having a detergent concentration of 0.5%. Then, 40 cc of the butter-incorporated detergent solution was charged in a glass cylinder, and the solution was agitated for about 10 minutes by turning the cylinder. Just after stopping of the agitation, the foam height was measured.

Enzyme Inhibition Rate

A certain relation exists between the activity inhibition of enzyme invertase by the surface active agent and the skin chapping.

The enzyme inhibition rate was measured according to the method described in *Journal of the Japan Oil Chemists' Society* 21, 3, p. 151 (1972) in the following manner:

Distilled water was added to 5 ml of an invertase solution (manufactured by BDH Chemical Ltd., 340 E.U. per milliliter) so that the total volume was 100 ml, and the resulting diluted invertase composition was added to an aqueous solution of sucrose (30% solution of saccharose of the special grade manufactured by Wako Junyaku in distilled water) maintained at 40° C. A detergent was added to the resulting solution at a concentration of 1% by weight. After 3 hours, the amount of sucrose decomposed by invertase was measured and the result was compared with the result obtained when the detergent was not added.

EXAMPLE 2

A liquid detergent having the following composition was prepared:

| | |
|---|---|
| Magnesium poloyxyethylene alkyl sulfate ($\overline{R}$ = 13.5, $\overline{n}$ = 2.0, content of the salt of n = zero being 2%) | 13% |
| Sodium polyoxyethylene alkyl sulfate ($\overline{R}$ = 13.5, $\overline{n}$ = 2.0, content of the salt of n = zero being 2%) | 7% |
| Dimethyllauryl betaine | 5% |
| Ethyl alcohol | 10% |
| Perfume | 0.3% |
| Water | balance |
| Total | 100% |

The washing power of this detergent was 5 dishes, the foaming property was 85 mm, and the enzyme inhibition rate was 6% and the detergent had a mild action to skin.

EXAMPLE 3

A liquid having the following composition was prepared:

| | |
|---|---|
| Calcium polyoxyethylene alkyl sulfate ($\overline{R}$ = 13, $\overline{n}$ = 2.5, content of the salt of n = zero being 4%) | 5% |
| Magnesium polyoxyethylene alkyl sulfate ($\overline{R}$ = 13, $\overline{n}$ = 2.5, content of the salt of n = zero being 4%) | 10% |
| Sodium polyoxyethylene alkyl sulfate ($\overline{R}$ = 13, $\overline{n}$ = 2.5, content of the salt of n = zero being 4%) | 3% |
| Dimethylmyristyl betaine | 5% |
| Propylene glycol | 5% |
| Ethyl alcohol | 8% |
| Perfume | 0.3% |
| Water | balance |
| Total | 100% |

The washing power of this detergent was 5 dishes, the foaming property was 80 mm, and the enzyme inhibition rate was 5% and the detergent had a very mild action to skin.

EXAMPLE 4

A detergent of the present invention having the following composition and a comparative detergent outside the scope of the present invention were subjected to a skin chapping test.

Detergent of Present Invention

| | |
|---|---|
| Calcium polyoxyethylene alkyl sulfate (R=12.5, n=2.5, content of the salt of n=zero being 3 %) | 10% |
| Sodium polyoxyethylene alkyl sulfate (R=12.5, n=2.5, content of the salt of n=zero being 3 %) | 10% |
| Dimethyllauryl betaine | 3% |
| Ethyl alcohol | 15% |
| Urea | 15% |
| Ammonium chloride | 0.5% |
| Water | balance |
| Total | 100% |

Comparative Detergent

The detergent had the same composition as that of the detergent of the present invention except that the content of the salt of n=zero was 35%.

Test Method

A pair comparison test was conducted on both the left and right hands which had been immersed in detergent solutions.

Number of Men of the Test Panel 10 men for each pair.

Immersing Time 30 minutes per day, the test being conducted on two continuous days, the skin chapping being evaluated the next morning following the second day.

Detergent Concentration 1.2% aqueous solution of the detergent composition.

Immersing Temperature:

40° C.

Evaluation

The change of the left hand was evaluated based on the right hand according to the following scale:

+2: much better
+1: better
0: no difference
−1: poorer
−2: much poorer

The results were as follows:

| Combination | | Evaluation | | | | | |
|---|---|---|---|---|---|---|---|
| Left Hand | Right Hand | −2 | −1 | 0 | +1 | +2 | Total |
| Detergent of present invention | Comparaive detergent | 0 | 0 | 2 | 3 | 5 | +13 |
| Comparative detergent | Detergent of present invention | 4 | 3 | 3 | 0 | 0 | −11 |

The embodiments of the invention in which an exclusive property or privilege is claimed are defined as follows:

1. A liquid detergent composition consisting essentially of

A. from 5 to 40 weight percent of a mixture of polyoxyethylene alkyl ether sulfate salts having the formula $$R—O—(CH_2CH_2O)_nSO_3M$$

wherein R is alkyl having on the average from 11 to 16 carbon atoms; n is from 1.0 to 2.6 as the average number of ethylene oxide units of component A, component A consisting of from zero to 5 weight percent of compounds in which n equals zero, from zero to 18 weight percent of compounds in which n equals 3 or more and higher than 77 weight percent of compounds in which n is one or 2; and M is a monovalent metal ion selected from the group consisting of sodium ion and potassium ion or a divalent metal ion selected from the group consisting of calcium ion and magnesium ion, with the proviso that M is said divalent metal ion or mixture thereof for from 15 to 98 weight percent of the total weight of component A, and that in the balance of component A, M is said monovalent metal ion or mixture thereof;

B. 0.1 to 20% by weight of a betaine amphoteric surface active agent having the formula

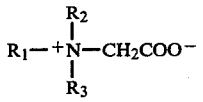

wherein $R_1$ is alkyl having 8 to 20 carbon atoms and $R_2$ and $R_3$ are alkyls having one to 3 carbon atoms, the weight ratio of B/A being in the range of from 0.01/1 to 2.0/1, and C. the balance of the composition consisting essentially of water.

2. A composition according to claim 1 in which said monovalent metal ion is sodium ion and said divalent ion is calcium ion.

3. A composition according to claim 1 in which component B is dimethyllauryl betaine.

4. A composition according to claim 1 in which the weight ratio of B/A is from 3/20 to 5/20.

5. A composition according to claim 1 in which the weight ratio of compounds in which M is said divalent metal ion to compounds in which M is said monovalent metal ion, is in the range of from 50/50 to 15/3.

6. A liquid detergent composition according to claim 1 in which said polyoxyethylene alkyl ether sulfate salt is prepared by adducting ethylene oxide to an alkanol having from 11 to 16 carbon atoms, then distilling the resulting ethylene oxide adduct of said alkanol to remove compounds in which n is zero and n is 3 or more, then sulfating and neutralizing said adduct to obtain said component A.

7. A liquid detergent composition according to claim 1 in which R has from 13 to 14.5 carbon atoms on the average, n is from 1.5 to 2 carbon atoms on the average, said monovalent metal ion is Na, said divalent metal ion is Ca and the ratio of (Ca/Na) is from (70/30) to (50/50) and said component B is dimethyllauryl betaine.

8. A composition according to claim 1 in which the weight ratio of B/A is from (0.03/1) to (0.5/1).

* * * * *